US010057691B2

(12) United States Patent
Linghu et al.

(10) Patent No.: US 10,057,691 B2
(45) Date of Patent: Aug. 21, 2018

(54) MINIATURE SOUNDER

(71) Applicants: Ronglin Linghu, Shenzhen (CN); Bo Xiao, Shenzhen (CN)

(72) Inventors: Ronglin Linghu, Shenzhen (CN); Bo Xiao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/416,156

(22) Filed: Jan. 26, 2017

(65) Prior Publication Data

US 2017/0347204 A1 Nov. 30, 2017

(30) Foreign Application Priority Data

May 26, 2016 (CN) ..... 2016 2 0488398 U

(51) Int. Cl.

| | |
|---|---|
| ***H04R 23/02*** | (2006.01) |
| ***H04R 1/28*** | (2006.01) |
| ***H04R 7/14*** | (2006.01) |
| ***H04R 7/18*** | (2006.01) |
| ***H04R 29/00*** | (2006.01) |

(Continued)

(52) U.S. Cl.

CPC ..... *H04R 23/02* (2013.01); *H04R 1/2807* (2013.01); *H04R 1/2869* (2013.01); *H04R 7/14* (2013.01); *H04R 7/18* (2013.01); *H04R 7/20* (2013.01); *H04R 9/06* (2013.01); *H04R 29/003* (2013.01); *H04R 7/04* (2013.01); *H04R 7/06* (2013.01); *H04R 9/043* (2013.01); *H04R 2307/204* (2013.01)

(58) Field of Classification Search

CPC ..... H04R 9/025; H04R 2499/11; H04R 9/06; H04R 9/045; H04R 9/063; H04R 1/06; H04R 31/006; H04R 9/02; H04R 2209/022

USPC ..... 381/398, 412, 401, 386, 396, 420, 42, 381/151; 181/171, 144, 157, 170, 173

See application file for complete search history.

(56) References Cited

U.S. PATENT DOCUMENTS 2,718,563 A * 9/1955 Nicholides ..... H04R 1/08 381/162

4,905,575 A * 3/1990 Knecht ..... F01B 19/00 338/4

(Continued)

*Primary Examiner* — Curtis Kuntz
*Assistant Examiner* — Julie X Dang
(74) *Attorney, Agent, or Firm* — Na Xu; IPro, PLLC

(57) ABSTRACT

Some embodiments of the present invention disclose a miniature sounder. The miniature sounder includes a frame, and a vibration system and a magnetic system that are fixedly connected to the frame; the magnetic system includes a lower clamping board, a primary magnet that disposed on the lower clamping board, a cushion that disposed on the lower clamping board and surrounding the primary magnet and a secondary magnet that disposed on the cushion and surrounding the primary magnet, the cushion being disposed between the secondary magnet and the lower clamping board; and the vibration system includes a voice diaphragm, a voice coil that disposed below the voice diaphragm and causing the voice diaphragm to vibrate and generate a sound and a vibration diaphragm elastically supporting the voice coil, the vibration diaphragm comprising a corrugated rim portion, a fixing portion and a connecting portion.

13 Claims, 4 Drawing Sheets

(51) Int. Cl.

| | |
|---|---|
| ***H04R 7/20*** | (2006.01) |
| ***H04R 9/06*** | (2006.01) |
| *H04R 7/06* | (2006.01) |
| *H04R 7/04* | (2006.01) |
| *H04R 9/04* | (2006.01) |

(56) References Cited

U.S. PATENT DOCUMENTS

| | | | | |
|---|---|---|---|---|
| 7,480,391 | B2 * | 1/2009 | Kobayashi | H04R 7/20 381/398 |
| 2010/0135519 | A1 * | 6/2010 | Werners | G10K 9/12 381/398 |
| 2013/0259289 | A1 * | 10/2013 | Zhang | H04R 9/025 381/412 |
| 2014/0119591 | A1 * | 5/2014 | Meng | H04R 9/02 381/386 |
| 2015/0016659 | A1 * | 1/2015 | Wang | H04R 9/06 381/412 |
| 2015/0163597 | A1 * | 6/2015 | Meng | H04R 9/025 381/412 |

* cited by examiner

MINIATURE SOUNDER

TECHNICAL FIELD

This invention relates to the technical field of electro-acoustic conversion, and in particular, relates to a miniature sounder.

BACKGROUND

In recent years, with the development of technologies, particularly, the drastic development of mobile communications technologies, more and more mobile electronic devices are being applied in people's daily life, for example, smart phones, tablet computers, laptops and multifunctional media players, which have become indispensable articles in people's life. In these mobile electronic devices, voice playing devices are an important part, and the voice quality directly affects user experience in using these mobile electronic devices.

Miniatures are voice playing devices, and the structure of the miniature sounder directly affects the voice quality. A miniature sounder in the related art includes a voice diaphragm and a voice coil causing the voice diaphragm to vibrate and generate a sound. Since the voice coil is only adhered to the voice diaphragm and lacks effective support, the voice coil may simply swing during vibration, thereby affecting the voice quality. In addition, the voice coil is provided with voice coil leads which are soldered to a solder pad to implement electric signal transmission to an external circuit, the leads of the voice coil are wired in a long way, a space for wiring of the leads needs to be provided inside the device, and the collision noise caused by the leads of the voice coil needs to be prevented. As a result, design complexity of the internal structure of the device is greatly increased.

Therefore, a novel miniature sounder is essential to invent in order to solve above technical problems.

SUMMARY

Some embodiments of the present invention provide a miniature sounder capable of solving the problem that the voice coil swings and optimizing the electrical connection of the voice coil.

The objective of some embodiment of the present invention is achieved as follows:

A miniature sounder is provided. The miniature sounder includes a frame, a vibration system and a magnetic system. The vibration system and the magnetic system are fixedly connected to the frame; wherein: the magnetic system includes a lower clamping board, a primacy magnet, a cushion and a secondary magnet. The primary magnet disposed on the lower clamping board, the cushion disposed on the lower clamping board and surrounding the primary magnet and the secondary magnet disposed on the cushion and surrounding the primary magnet, the cushion being disposed between the secondary magnet and the lower clamping board; and the vibration system includes a voice diaphragm, a voice coil and a vibration diaphragm. The voice coil disposed below the voice diaphragm and causing the voice diaphragm to vibrate and generate a sound and the vibration diaphragm elastically supporting the voice coil; the vibration diaphragm includes a corrugated rim portion, a fixing portion and connecting portion. The fixing portion extends from an outer periphery of the corrugated rim portion and a connecting portion extends from an inner periphery of the corrugated rim portion, wherein the fixing portion is clamped between the secondary magnet and the cushion. The connecting portion is connected to the voice coil, the vibration diaphragm is further provided with an electrically conductive pathway that has an electrical connection between the voice coil and an external circuit, and the voice coil transmits an electric signal to the external circuit via the electrically conductive pathway.

In one embodiment, the vibration diaphragm includes a non-electrically conductive base material layer and an electrically conductive layer that forms the electrically conductive pathway, the electrically conductive layer being disposed on a surface of the base material layer.

In one embodiment, the vibration diaphragm includes a non-electrically conductive base material layer and an electrically conductive layer that forms the electrically conductive pathway, the electrically conductive layer being disposed between two base material layers.

In one embodiment, the base material layer is a polymer thin-film layer.

In one embodiment, the electrically conductive layer is a metal material layer or an electrically conductive polymer layer.

In one embodiment, the cushion is made from a magnetically conductive material.

In one embodiment, the cushion is formed by extending from the lower clamping board, and is integrally formed with the lower clamping board.

In one embodiment, the corrugated rim portion is a concave structure formed by a recess towards one side of the lower clamping board, and the secondary magnet at least partially extends to an upper portion of the corrugated rim portion.

In one embodiment, the frame is provided with a fixing block extending towards the cushion, the fixing block cooperating to form a receiving groove for receiving the secondary magnet, and the secondary magnet is received in the receiving groove.

Some embodiments of the present invention have the following beneficial effects: In the miniature sounder according to some embodiment of the present invention, a vibration diaphragm elastically supports the voice coil, such that the problem that the voice coil swings in the miniature sounder is solved, the voice quality is improved, the maximum low-frequency output sound pressure of the miniature sounder is improved, and the electrical connection manner of the voice coil is optimized.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention. Embodiments of the invention are described, by way of example only, with reference to the accompanying drawings, in which.

Figure 1:
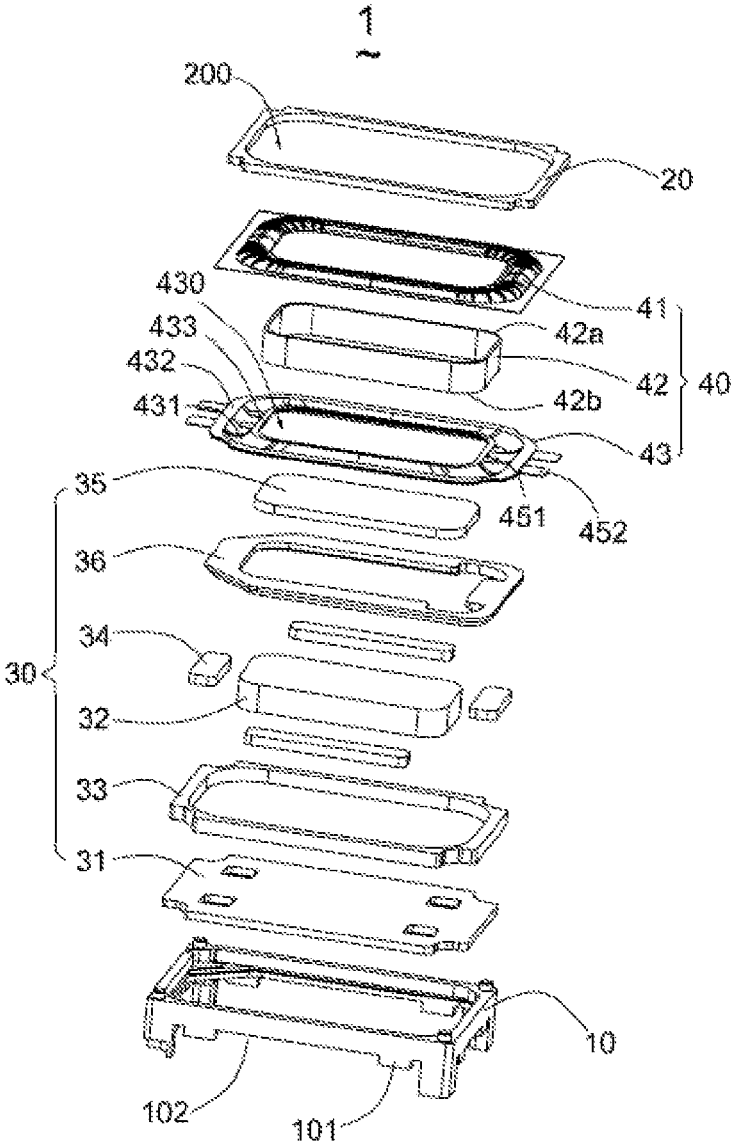
FIG. 1 is a three-dimensional exploded diagram of a miniature sounder according to some embodiments of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

This specification discloses one or more embodiments that incorporate the features of this invention. The disclosed embodiment(s) merely exemplify the invention. The scope of the invention is not limited to the disclosed embodiment(s). The invention is defined by the claims appended hereto. The embodiment(s) described, and references in the specification to "one embodiment", "an embodiment". "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Some embodiments of the present invention are further described with reference to the accompanying drawings.

As illustrated in FIG. 1 to FIG. 4, a miniature sounder 1 provided by this invention includes a frame 10, a front cover 20 covering the frame 10, and a magnetic system 30 and a vibration system 40 that are fixedly connected to the frame 10.

The magnetic system 30 includes a lower clamping board 31, a primary magnet 32, a cushion 33 and a secondary magnet 34. The primary magnet 32 disposed on the lower clamping board 31, the cushion 33 disposed on the lower clamping board 31 and surrounding the primary magnet 32 and the secondary magnet 34 disposed on the cushion 33 and surrounding the primary magnet 32, wherein the cushion 33 is disposed between the secondary magnet 34 and the lower clamping board 31.

Figure 2:
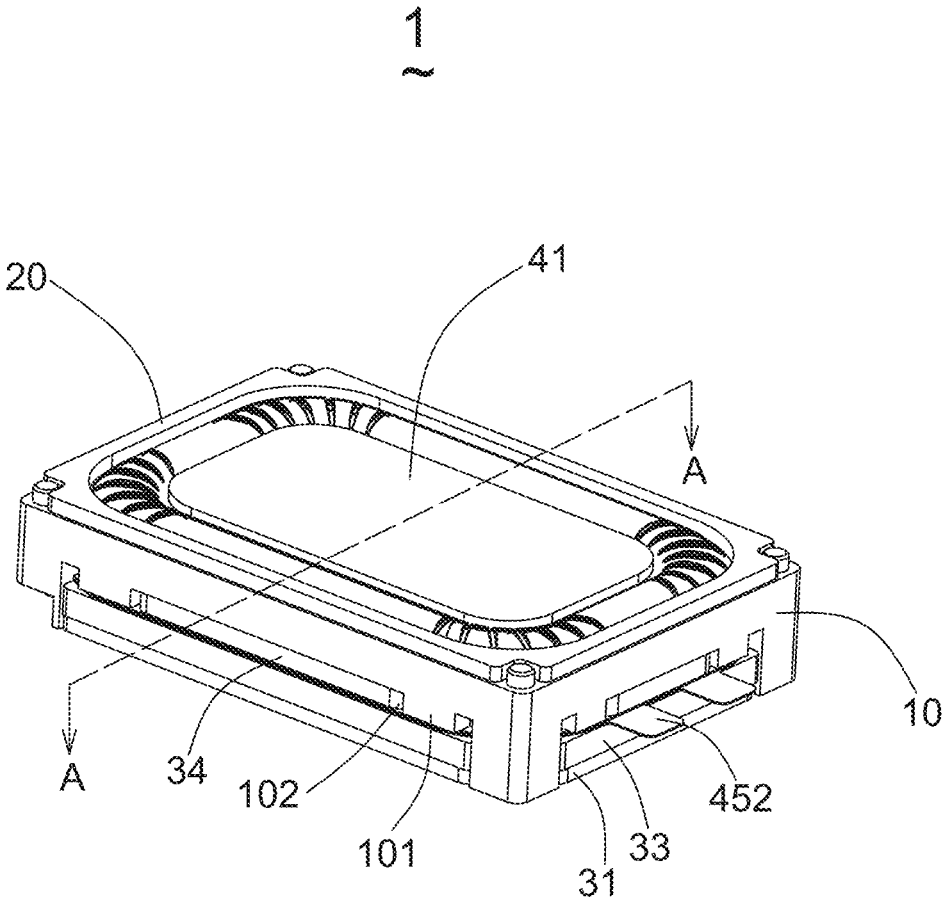
FIG. 2 is a three-dimensional diagram of a miniature sounder according to some embodiments of the present invention.
Figure 3:
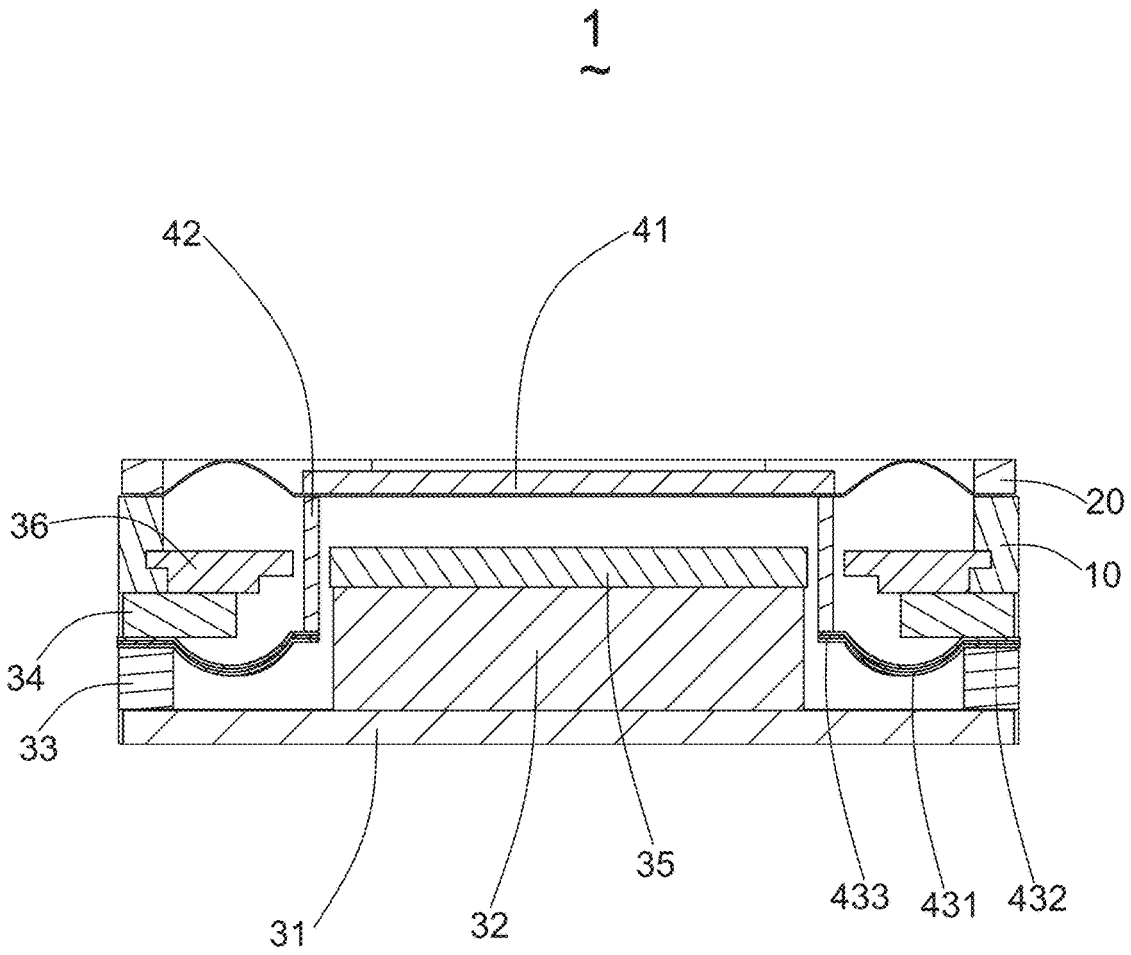
FIG. 3 is a sectional view taken from A-A line in FIG. 2.

The vibration system 40 includes a voice diaphragm 41, a voice coil 42 disposed below the voice diaphragm 41 and causing the voice diaphragm 41 to vibrate and generate a sound and a vibration diaphragm 43 elastically supporting the voice coil 42. Referring to FIG. 1 and FIG. 2, a sound hole 200 is formed on the front cover 20, corresponding to the voice diaphragm 41. The voice diaphragm 41 is sandwiched between the front cover 20 and the frame 10.

The vibration diaphragm 43 includes a corrugated rim portion 431, a fixing portion 432 and a connecting portion 433. The fixing portion 432 extends from an outer periphery of the corrugated rim portion 431 and a connecting portion 433 extends from an inner periphery of the corrugated rim portion 431, wherein the fixing portion 432 is clamped between the secondary magnet 34 and the cushion 33, and the connecting portion 433 is connected to the voice coil 42. In this embodiment, the connecting portion 433 is fixed to a lower end 42*b* of the voice coil 42, and an upper end 42*a* of the voice coil 42 is connected to the vibration diaphragm 41. A through portion 430 is formed and surrounded by the connecting portion 433, and referring to FIG. 1 and FIG. 4, the primary magnet 32 is fixed on the lower clamping board 31 and extending from the lower clamping board 31 towards the voice diaphragm 41, and apparently the primary magnet 32 runs through the through portion 430 and is spaced apart from the connecting portion 433.

The vibration diaphragm 43 is further provided with an electrically conductive pathway that has an electrical connection between the voice coil 42 and an external circuit, and the voice coil 42 transmits an electric signal to the external circuit via the electrically conductive pathway.

Figure 4:
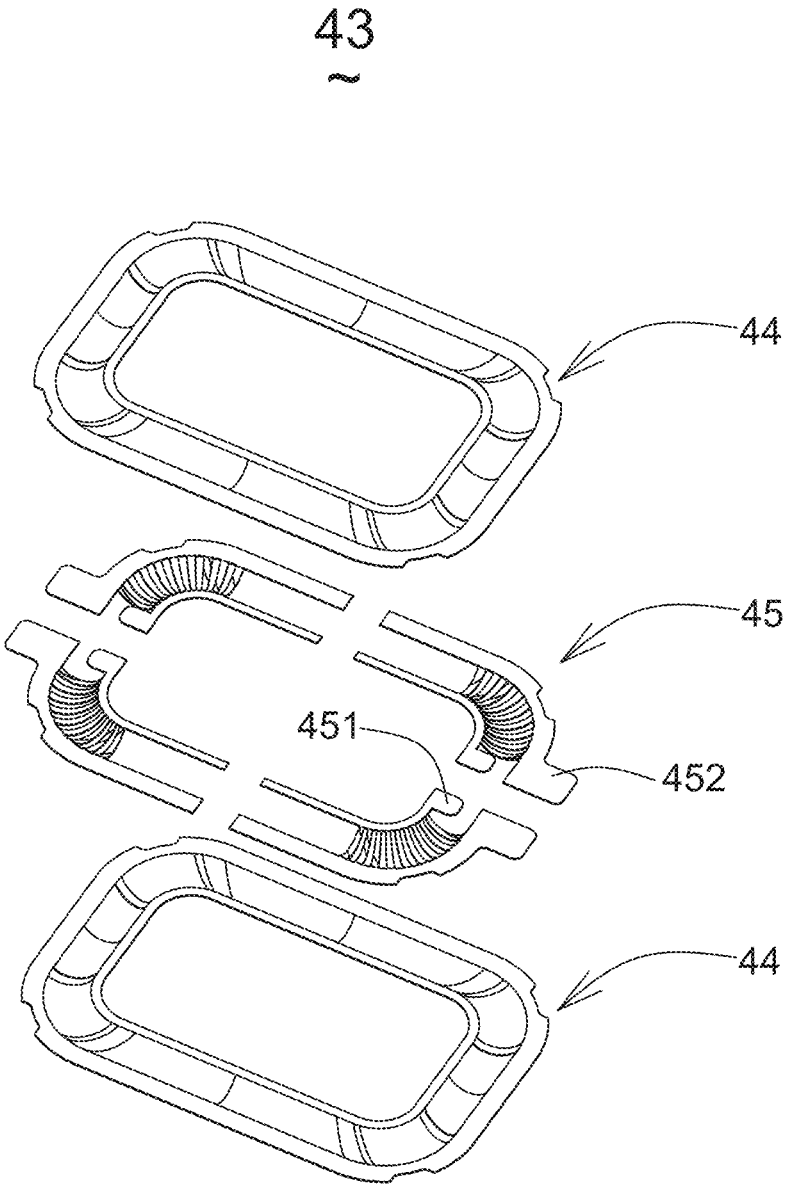
FIG. 4 is a three-dimensional exploded diagram of a vibration diaphragm of a miniature sounder according to some embodiments of the present invention.

The vibration diaphragm 43 includes a non-electrically conductive base material layer 44 and an electrically conductive layer 45 forming the electrically conductive pathway. The vibration diaphragm 43 may be in a two-layer structure, and in this case, the electrically conductive layer 45 is disposed on a surface of the base material layer 44. Nevertheless, the vibration diaphragm 43 may also be in a structure having more than two layers. For example, the vibration diaphragm 43 may be in a three-layer structure as illustrated in FIG. 4, and in this case, the electrically conductive layer 45 is disposed between two base material layers 44. The base material layer 44 is a polymer thin-film layer, the electrically conductive layer 45 is a metal material layer or an electrically conductive polymer layer, and the electrically conductive layer 45 is provided with a first connecting end 451 electrically connected to the voice coil 42 and a second connecting end 452 electrically connected to the external circuit.

The cushion 33 may be made from a magnetically conductive material for conducting the magnetic field, or may be made from a non-magnetically conductive material as long as the vibration diaphragm 43 is raised up by the cushion such that the vibration diaphragm 43 has a sufficient space to vibrate. In this embodiment, the cushion 33 is arranged separately from the lower clamping board 31. Nevertheless, the cushion 33 may also be formed by extending from the lower clamping board 31, and is integrally formed with the lower clamping board 31. The corrugated rim portion 431 is a concave structure formed by a recess towards one side of the lower clamping board 31, and the secondary magnet 34 at least partially extends to an upper portion of the corrugated rim portion 431. In this way, the space above the corrugated rim portion 431 is fully utilized to make the secondary magnet 34 greater so as to enhance the magnetic performance of the magnetic system 30. However, such configuration shall not affect the vibration of the vibration diaphragm 43. The frame 10 is provided with a fixing block 101 extending towards the cushion 33, wherein the fixing block 101 cooperates to form a receiving groove 102 for receiving the secondary magnets 34, and the secondary magnets 34 is received in the receiving groove 102.

In the miniature sounder according to some embodiments of the present invention, a vibration diaphragm elastically supports the voice coil, such that the problem that the voice coil swings in the miniature sounder is solved, the voice quality is improved, the maximum low-frequency output sound pressure of the miniature sounder is improved, and the electrical connection manner of the voice coil is optimized.

Described above are merely exemplary embodiments of this invention. It should be noted that persons of ordinary skill in the art would make various improvements without departing from the inventive concept of this invention, and such improvements shall fall within the protection scope of this invention.

What is claimed is:

1. A miniature sounder, comprising: a frame, and a vibration system and a magnetic system that are fixedly connected to the frame; wherein the magnetic system comprises a lower clamping board, a primary magnet, a cushion and a secondary magnet, the primary magnet being disposed on the lower clamping board, the cushion being disposed on the lower clamping board and surrounding the primary magnet and the secondary magnet being disposed on the cushion and surrounding the primary magnet, the cushion being disposed between the secondary magnet and the lower clamping board; wherein the vibration system comprises a voice diaphragm, a voice coil disposed below the voice diaphragm and causing the voice diaphragm to vibrate and generate a sound and a vibration diaphragm elastically supporting the voice coil, the vibration diaphragm comprising a corrugated rim portion, a fixing portion and a connecting portion, wherein the fixing portion extends from an outer periphery of the corrugated rim portion and a connecting portion extends from an inner periphery of the corrugated rim portion; and, wherein the fixing portion is clamped between the secondary magnet and the cushion, the connecting portion is connected to the voice coil, the vibration diaphragm is provided with an electrically conductive pathway that has an electrical connection between the voice coil and an external circuit, and the voice coil transmits an electric signal to the external circuit via the electrically conductive pathway, and a through portion is surrounded by the connecting portion, the primary magnet extending from the lower clamping board towards the voice diaphragm, running through the through portion and spaced apart from the connecting portion; wherein the vibration diaphragm comprises a non-electrically conductive base material layer and an electrically conductive layer forming the electrically conductive pathway, the electrically conductive layer being disposed on a surface of the base material layer.

2. The miniature sounder according to claim 1, wherein the vibration diaphragm comprises a non-electrically conductive base material layer and an electrically conductive layer forming the electrically conductive pathway, the electrically conductive layer being disposed between two base material layers.

3. The miniature sounder according to claim 2, wherein the base material layer is a polymer thin-film layer.

4. The miniature sounder according to claim 2, wherein the electrically conductive layer is a metal material layer or an electrically conductive polymer layer.

5. The miniature sounder according to claim 1, wherein the cushion is made from a magnetically conductive material.

6. The miniature sounder according to claim 1, wherein the cushion is formed by extending from the lower clamping board, and is integrally formed with the lower clamping board.

7. The miniature sounder according to claim 1, wherein the corrugated rim portion is a concave structure formed by a recess towards one side of the lower clamping board, and the secondary magnet at least partially extends to an upper portion of the corrugated rim portion.

8. The miniature sounder according to claim 1, wherein the frame is provided with a fixing block extending towards the cushion, the fixing block cooperating to form a receiving groove for receiving the secondary magnet, and the secondary magnet is received in the receiving groove.

9. The miniature sounder according to claim 2, wherein the base material layer is a polymer thin-film layer.

10. The miniature sounder according to claim 2, wherein the electrically conductive layer is a metal material layer or an electrically conductive polymer layer.

11. The miniature sounder according to claim 1, wherein the miniature sounder further comprises a front cover covering the frame, and the voice diaphragm is sandwiched between the front cover and the frame.

12. The miniature sounder according to claim 1 wherein a sound hole is formed on the front cover, corresponding to the voice diaphragm.

13. The miniature sounder according to claim 1, wherein the voice diaphragm and the vibration diaphragm are fixed to two opposite ends of the voice coil respectively.

* * * * *